US011542673B2

(12) United States Patent
Stokes et al.

(10) Patent No.: US 11,542,673 B2
(45) Date of Patent: Jan. 3, 2023

(54) COLLAPSIBLE MARKER

(71) Applicant: DCSS LLC, Mendon, UT (US)

(72) Inventors: Steven G. Stokes, Mendon, UT (US); Stephen Crosby, Logan, UT (US)

(73) Assignee: DCSS LLC, Mendon, UT (US)

( * ) Notice: Subject to any disclaimer, the term of this patent is extended or adjusted under 35 U.S.C. 154(b) by 0 days.

(21) Appl. No.: 16/841,517

(22) Filed: Apr. 6, 2020

(65) Prior Publication Data

US 2020/0318299 A1 Oct. 8, 2020

Related U.S. Application Data

(60) Provisional application No. 62/829,434, filed on Apr. 4, 2019.

(51) Int. Cl.
*E01F 9/646* (2016.01)
*E01F 9/692* (2016.01)
*E01F 9/654* (2016.01)

(52) U.S. Cl.
CPC ..... *E01F 9/646* (2016.02); *E01F 9/654* (2016.02); *E01F 9/692* (2016.02)

(58) Field of Classification Search
CPC . E01F 9/646; E01F 9/654; E01F 9/688; E01F 9/692; E10F 9/646; E10F 9/654; E10F 9/688; E10F 9/692
USPC ..... 116/63 P
See application file for complete search history.

(56) References Cited

U.S. PATENT DOCUMENTS 2,275,711 A * 3/1942 Ybanez ..... E01F 9/688 116/67 R
2,762,327 A * 9/1956 Weig ..... E01F 9/688 116/63 R
2,762,328 A * 9/1956 Weig ..... E01F 9/688 116/63 R
2,954,005 A 9/1960 Cioffi et al.
3,132,624 A * 5/1964 Shoemaker, Jr. ..... E01F 9/688 116/63 R
4,006,702 A 2/1977 St. Cyr
4,197,807 A 4/1980 Campbell
4,256,050 A * 3/1981 Barnard ..... B60Q 7/005 116/63 C
4,973,190 A * 11/1990 Erwin ..... E01F 9/688 116/63 P
5,195,453 A * 3/1993 McGibbon, II ..... E01F 9/688 116/63 C (Continued)

FOREIGN PATENT DOCUMENTS

CN 200940257 Y 8/2007
EP 3629311 * 4/2020
WO 9316234 A1 8/1993

*Primary Examiner* — Gary S Hartmann
(74) *Attorney, Agent, or Firm* — Kunzler Bean & Adamson

(57) ABSTRACT

An apparatus including a collapsible body, a base, and a cap. The body including a spring element coupled to the body to apply an extension force. The spring element having a helical geometry. The collapsible body has a high visibility characteristic. The base is coupled to a first end of the body and has a shape to secure the body and the spring element relative to the base and to receive the body in a collapsed state. The base includes a base coupling element to secure the body in the collapsed state. The cap is coupled to a second end of the body opposite the first end, the cap to, at least partially, close the second end of the body.

12 Claims, 11 Drawing Sheets

(56) References Cited

U.S. PATENT DOCUMENTS 5,305,705 A * 4/1994 Gagliano ..... E01F 9/654 116/63 P
5,375,554 A * 12/1994 Yen ..... B60Q 7/005 116/63 C
5,488,792 A * 2/1996 Kwok ..... B60Q 7/00 116/63 C
5,713,694 A * 2/1998 Monda ..... E01F 9/688 116/63 P
6,338,311 B1 1/2002 Ho
6,448,902 B1 * 9/2002 Tung ..... B60Q 7/00 340/471
6,556,147 B1 * 4/2003 Fisher ..... E01F 9/617 116/63 C
6,766,760 B2 * 7/2004 Garcia ..... E01F 9/688 116/63 C
6,928,952 B2 * 8/2005 Garcia ..... E01F 9/688 116/63 C
7,003,908 B2 * 2/2006 Bober ..... A47L 13/00 116/63 R
7,007,420 B2 * 3/2006 Garcia ..... G09F 7/22 116/63 P
7,007,630 B2 * 3/2006 Garcia ..... E01F 9/688 116/63 C
7,089,878 B2 * 8/2006 Huang ..... E01F 9/688 116/63 C
7,228,813 B2 * 6/2007 Flamingo ..... E01F 9/688 116/63 C
7,811,026 B1 * 10/2010 Kulp ..... E01F 9/688 404/10
10,997,856 B2 * 5/2021 Lykkja ..... E01F 9/646
2004/0083943 A1 5/2004 Huang
2004/0237875 A1 12/2004 Garcia
2005/0076822 A1 4/2005 Levine
2006/0016383 A1 1/2006 Flamingo et al.
2014/0230719 A1 * 8/2014 Thomas ..... E01F 9/688 116/63 C
2017/0030035 A1 * 2/2017 Parnow ..... E01F 9/654

* cited by examiner

COLLAPSIBLE MARKER

CROSS-REFERENCES TO RELATED APPLICATIONS

This application claims the benefit of, and claims priority to U.S. Provisional Patent Application No. 62/829,434 entitled "COLLAPSIBLE MARKER" and filed on 4 Apr. 2019 for Steven Stokes, which is incorporated herein by reference.

FIELD

This invention relates to hazard markers and more particularly relates to collapsible markers.

BACKGROUND

Markers are frequently implemented at the scene of an accident, construction, or other hazard which benefits from demarcation. Markers draw the attention of people in the vicinity whether they are passing through or persisting in the area for work, residence, diversion, or otherwise. Markers draw attention to potential hazards with color, reflection, size, signage, and the like.

SUMMARY

An apparatus is disclosed. The apparatus includes a collapsible body, a base, and a cap. The body including a spring element coupled to the body to apply an extension force. The spring element having a helical geometry. The collapsible body has a high visibility characteristic. The base is coupled to a first end of the body and has a shape to secure the body and the spring element relative to the base and to receive the body in a collapsed state. The base includes a base coupling element to secure the body in the collapsed state. The cap is coupled to a second end of the body opposite the first end, the cap to, at least partially, close the second end of the body.

A method is also disclosed. The method includes forming a collapsible body comprising a first end and a second end. The method also includes coupling a spring element to the body extending between the first end and the second end to apply and extension force to the body. The method also includes coupling a base to the first end of the body. The base having a shape to secure the body and the spring element relative to the base and to receive the body in a collapsed state. The base comprises a base coupling element to secure the body in the collapsed state. The method also includes coupling a cap to the second end of the base to, at least partially, close the second end of the body.

A method of using a collapsible marker is also disclosed. The method includes disengaging a cap coupling element on a cap of the collapsible marker from a base coupling element of a base of the collapsible marker. The cap is coupled to a first end of a body of the collapsible marker and the base is coupled to a second end of the body of the collapsible marker. The method also includes allowing a spring element disposed in the body of the collapsible marker to apply an extension force to the body of the collapsible marker to extend the body of the collapsible marker to move the first end of the body away from the second end of the body. The method also includes compressing the spring element to collapse the body of the collapsible marker. The method also includes securing the cap to the base by engaging the cap coupling element with the base coupling element to maintain the collapsible marker in a collapsed state.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to give a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 1:
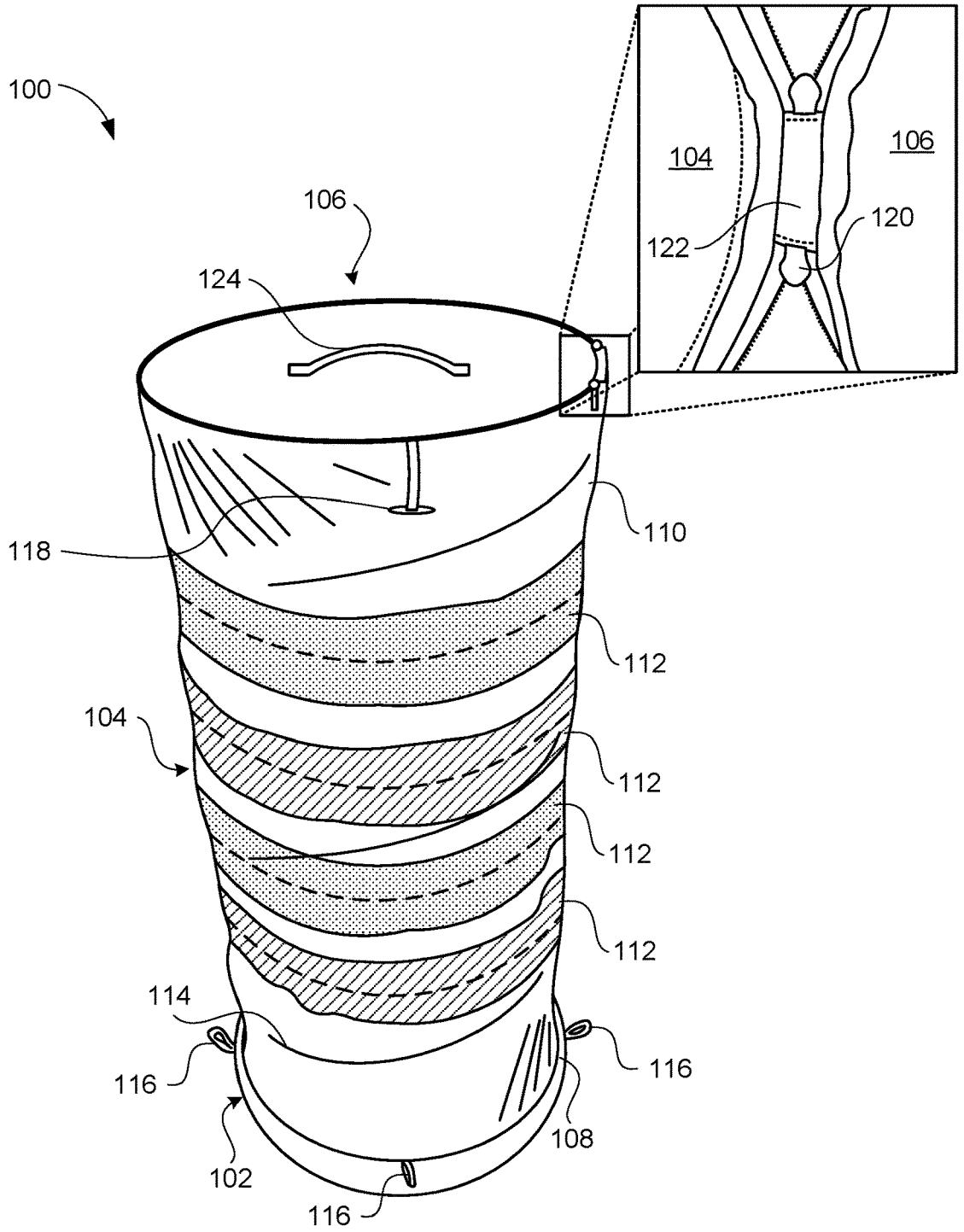
FIG. 1 is a perspective view of one embodiment of a collapsible marker.

FIG. 1 depicts a collapsible marker system 100. The collapsible marker system (hereinafter "marker") 100 includes a base 102, a body 104, and a cap 106. In the illustrated embodiments, the body 104 is coupled to the base 102 at a first end and the cap 106 is coupled to the body 104 at a second end of the body 104 opposite the first end.

In the illustrated embodiment, the base 102 is circular, however, the base 102 may be rectangular, oval, hexagonal, or the like. The base 102 may provide a weight and stability to the marker 100. The base 102 may be formed entirely, or in part, of a rubber or rubberized material. The material of the base 102 may be resilient to mechanical, chemical, and thermal conditions. The material of the base 102 may also provide grip relative to the ground or surface on which it is placed.

The base 102 may include a weight component or may have an inherent weight sufficient to an application of the marker 100. The base 102 may include a lip 108 forming an annular protrusion to surround the body 104 of the marker 104. The base 102 may include a recess formed on an interior of the lip 108 to receive and secure the body 104 relative to the base 102. In other embodiments, the base 102 may include other hardware or securing elements or portions. For example, the base 102 may couple to the body 104 via a zipper, snaps, hooks, buttons, clips, pins, or the like.

The base 102 may also include base coupling elements 116. In the illustrated embodiment, the base coupling elements 116 correspond to cap coupling element 118 disposed on or near the cap 106. In the illustrated embodiment, the base coupling elements 116 are loops which correspond to cap coupling element 118 in the form of toggles on or near the cap 106. The base coupling elements 116 may be coupled to the base 102 via in-molding, bonding, adhering, attachment hardware, or the like. Additionally, the base coupling elements 116 may be coupled to the body 104 at or near the base 102. As the body 104 of the marker 100 is collapsed, the base coupling elements 116 may be connected to, receive, or otherwise coupled to the cap coupling elements 118 to secure the marker 100 in a collapsed state. Other types of coupling elements 116 and 118 are described herein.

In the illustrated embodiment, the body 104 has a generally cylindrical shape. In other embodiments, the body 104 may be more or less round and may include a square geometry. The body 104 includes an outer material 110. The outer material 110 may be flexible and may be abrasion and soil resistant. The outer material 110 is flexible to allow collapse of the body 104. Additionally, flexibility in the outer material 110 may facilitate wind and impact resilience. The outer material 110 may also have fire-resistant or retardant characteristics. In some embodiments, the outer material 110 is UV resistant.

The body 104 also includes a spring element 114. In the illustrated embodiment, the spring element 114 has a helical shape and is disposed in the body 104 to support the body 104 relative to the base 102. For example, the spring element 114 may be shaped to apply a radially outward force to the body 104 to maintain a shape of the body 104. Additionally, the radially outward force may increase a retention of the body 104 at the base 102. In some embodiments, the spring element 114 also applied a longitudinal force along the body 104. The longitudinal force tends to extend the body 104 to separate the base 102 from the cap 106. This force, applied by the spring element 114, may cause a "pop-up" or "self-erecting" action in the marker 100 when released. The spring element 114 may be round or have a non-round shape such as a square helix, flat sided helix, or the like. The spring element 114 may be a single piece element or may be formed by a plurality of pieces.

In some embodiments, the spring element 114 forms a complete or near-complete circumference or closed portion. A closed portion at an end of the spring element 114 may improve retention of the spring element 114 and/or body 104 relative to the base 102. In some embodiments, a closed portion may also be formed in the spring element 114 to correspond with the cap 106. The closed portion of the spring element 114 at the cap 106 may form or match the shape of the cap 106, reduce puncture or wear of the cap 106 at an end of the spring element 114, increase a structural rigidity or strength of the cap 106, and the like.

In some embodiments, the outer material 110 has a high-contrast or bright color to increase visibility of the marker 100. The outer material 110 may include a specific characteristic or treatment to provide a visual or functional effect such as a luminescence, reflectivity, opacity, translucency, reactivity, or the like.

Additionally, the body 104 may include visibility elements 112 coupled to the outer material 110 of the body 104 to be on an exterior of the body 104. The visibility elements 112 may be reflective material, lighting elements, colored material, or the like to increase a visibility of the marker 100. In some embodiments, the visibility elements 112 are annular rings of material which encompass a circumference of the body 104. In other embodiments, the visibility elements 112 may correspond to a portion of the body 104 without extend around the circumference of the body 104. The visibility elements 112 may be one or more single pieces or may be multiple pieces. The visibility elements 112 may have multiple shapes, colors, sizes, orientations, positions, and operations (reflective, luminescent, color, etc.).

In the illustrated embodiment, the cap 106 is positioned on the body 104 to be opposite the base 102. The cap 106 may form a closure of an internal space of the body 104. In some embodiments, the cap 106 is, at least partially, releasably coupled to the body 104. For example, the cap 106 may include a zipper 120, as shown. The zipper 120 may be replace or supplemented by other mechanisms such as snaps, hook-and-look, loop-and-toggle, magnets, buttons, or the like. In the illustrated embodiment, the zipper 120 is a double zipper with two pulls oriented to face and run opposite one another. In other embodiments, the zipper 120 may be a single zipper. In the illustrated embodiment, the cap 106 is attached to the body 104 via an attachment point 122. In some embodiments, the attachment point 122 forms a non-removable connection between the cap 106 and the body 104. In other embodiments, the attachment point 122 is omitted or forms a removable connection between the cap 106 and the body 104. The attachment point 122 may take the form of a close connection, as shown which forms a portion of the interface between the body 104 and the edge of the cap 106. In other embodiments, the attachment point 122 may be a tether or other connection which is separate from the edge of the cap 106 and allows the edge of the cap 106 to be made free from the edge of the body 104 without fully separating the cap 106 from the marker 100. For example, a tether may couple a center, or other portion, of the cap 106 to a portion of the body 104 or the base 102 to secure the cap 106 to the marker 100. Such a tether or other separate connection between the cap 106 and the body 104 or other component of the marker 100 may be permanent or configured to separately disconnect from the zipper 120 or other connection mechanisms securing the cap 106 to the body 104.

The cap 106 may also include one or more of the cap closure element 118. As described in part above, the cap closure element 118 couples to the base closure element 116 to secure the marker in a collapsed or semi-collapsed state. In some embodiments, the cap closure element 118 facilitates securing of the marker 100 to another marker or other structure such as a vehicle, wall, storage structure, or the like. The cap 106 may include a single cap closure element 118 or multiple cap closure elements 118. In some embodiments, the cap closure element 118 is coupled to the body 104 or forms a portion of a connection mechanism securing the cap 106 to the body 104.

In the illustrated embodiment, the cap 106 also includes a handle 124. The handle 124 may be a flexible, rigid, or semi-rigid material or combination of materials. The handle 124 may be sized to correspond to a human hand or to a tool or mechanism for positioning, placing, or otherwise situating the marker 100. In some embodiments, the handle 124 is sewn to the cap 106. In other embodiments, the handle 124 may be attached to the cap 106 via adhesives, molding, riveting, bonding, or the like. The handle 124 may be permanently or removably attached to the cap 106. Additionally, the handle 124 may be coupled exclusively to the cap 106 or may be coupled to the body 104 or other component of the marker 100 in a mutual or exclusive manner relative to the cap 106.

In the illustrated embodiment, the handle 124 is an additional portion of material coupled to the cap 106. In other embodiments, the handle 124 may be formed in the cap 106. For example, the handle 124 may be a slip, flap, or recess formed in the cap 106 or other component of the marker 100. The handle 124 may be adjustable or reconfigurable to accommodate a corresponding use or interface requirement.

In the illustrated embodiment, the handle 124 is shown as disposed in a center of the cap 106. In other embodiments, the handle 124 may be disposed nearer an edge of the cap 106. In other embodiments, one or more handles 124 may be disposed on other portions of the marker 100. For example, one or more handles 124 may be disposed on the body 104 of the marker 100. A handle 124 may be disposed on, or formed in, the base 102 of the marker 100.

Figure 2:
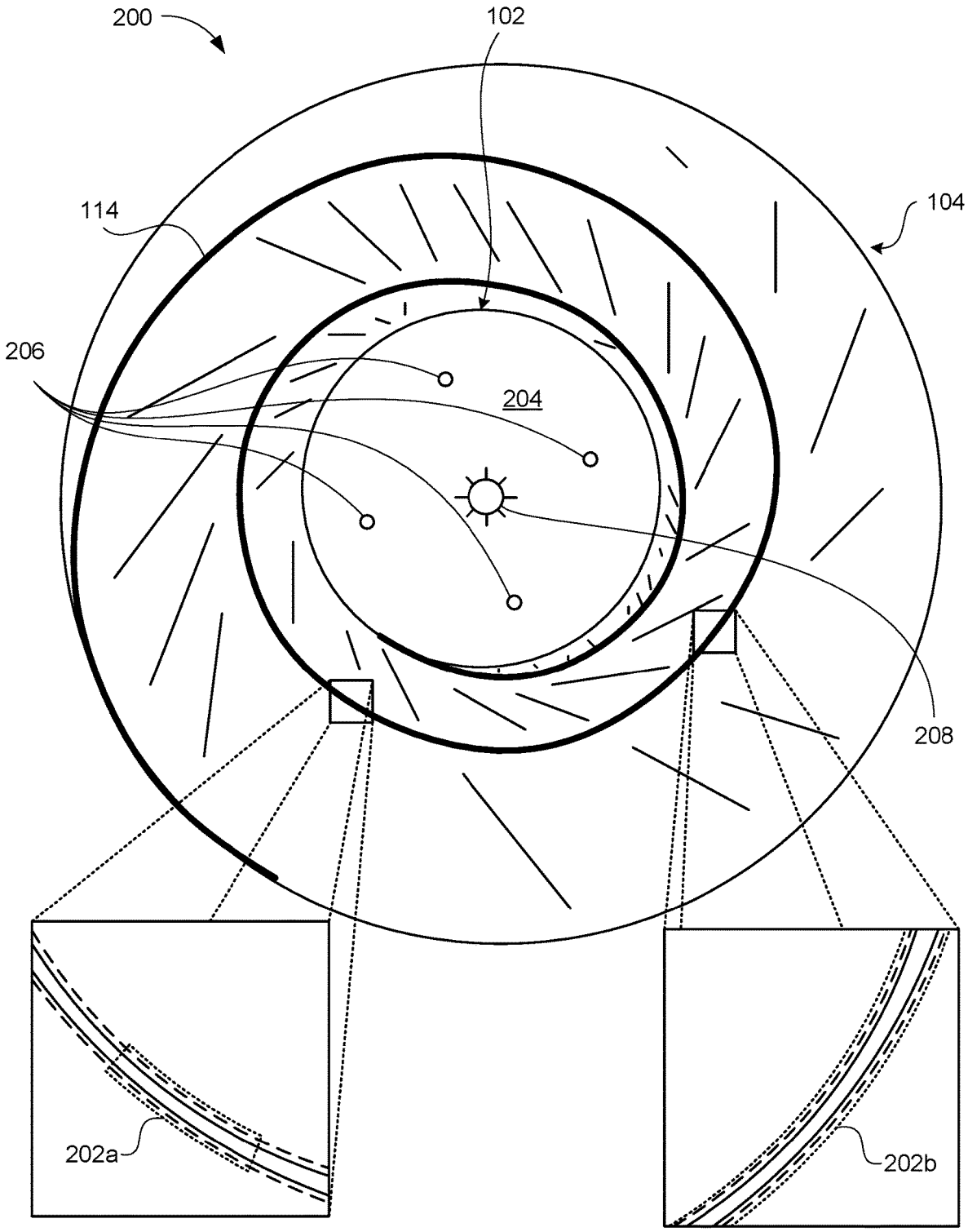
FIG. 2 is a perspective view of one embodiment of an interior of a collapsible marker.

FIG. 2 depicts a perspective view of an interior 200 of the marker 100 of FIG. 1. In the illustrated embodiment, the cap 106 is removed. The illustrated view of the interior 200 includes the body 104 and the base 102. The spring element 114 is disposed on the body 104 and, in the illustrated embodiment, spirals along the body 104 to the base 102. While, the spring element 114 is shown as terminating at the base 102, the spring element 114 may continue around a periphery of the base 102 as mentioned above. In some embodiments, the spring element 114 may provide a retaining force to secure the body 104 with respect to the base 102.

In the illustrated embodiment, the spring element 114 is secured on the body 104. In some embodiments, the spring element 114 is secured along the body 104 by retaining sleeves 202*a* and 202*b*. In some embodiments, the retaining sleeves 202*a* are short retaining sleeves 202*a* which extend over a relatively small portion of the spring element 114 to secure the spring element 114 relative to the body 104. The short retaining sleeves 202*a* may provide an increase in the ease of installing the spring element 114 relative to the body 104 and may reduce the time required to situate the spring element 114 relative to the body 104.

In other embodiments, the spring element 114 may be secured to the body 104 with a continuous retaining sleeve 202*b*. In some embodiments, the continuous sleeve 202*b* extends along a full length of the spring element 114 at the body 104. The continuous sleeve 202*b* may provide a more stable and/or uniform support for the spring element 114 along the body 104. In the illustrated embodiment, the spring element 114 is secured on the interior 200 of the marker 100 but may be secured on an exterior of the marker 100.

In the illustrated embodiment, the base 102 includes a plate 204. The plate 204 may be formed to fit within the base 102 and provide a retaining force securing the spring element 114 and/or body 104 relative to the base 102. The plate 204 may secured using hardware 206. The hardware 206 may include nuts, bolts, washers, stakes, screws, pins, clips, staples, rods, or the like. Additionally, the hardware 206 may be formed into the plate 204 or the base 102 and connected via bonding, adhesives, welds, or the like. Other removable and non-removable connections may be used to connect the base 102 and the plate 204.

In the illustrated embodiment, the plate 204 includes a lighting element 208. The lighting element 208 may be positioned in the plate 204 to provide illumination to the interior 200 of the marker 100 to improve visibility of the marker 100 in low-light conditions. In some embodiments, the lighting element 208 is self-container with a power source and illumination source in a single package. In other embodiments, the lighting element 208 may include a remote power source or connections for power supply from a remote power source. In some embodiments, the lighting element 208 may be coupled to a rechargeable power source. The lighting element 208 may include a power generator such as a solar panel, wind power generator, a hand crank, or the like. In some embodiments, the remote power source may be a power source that is external to the marker 100 such as a battery, via a vehicle connection, a utility grid, a generator, or the like.

Figure 3:
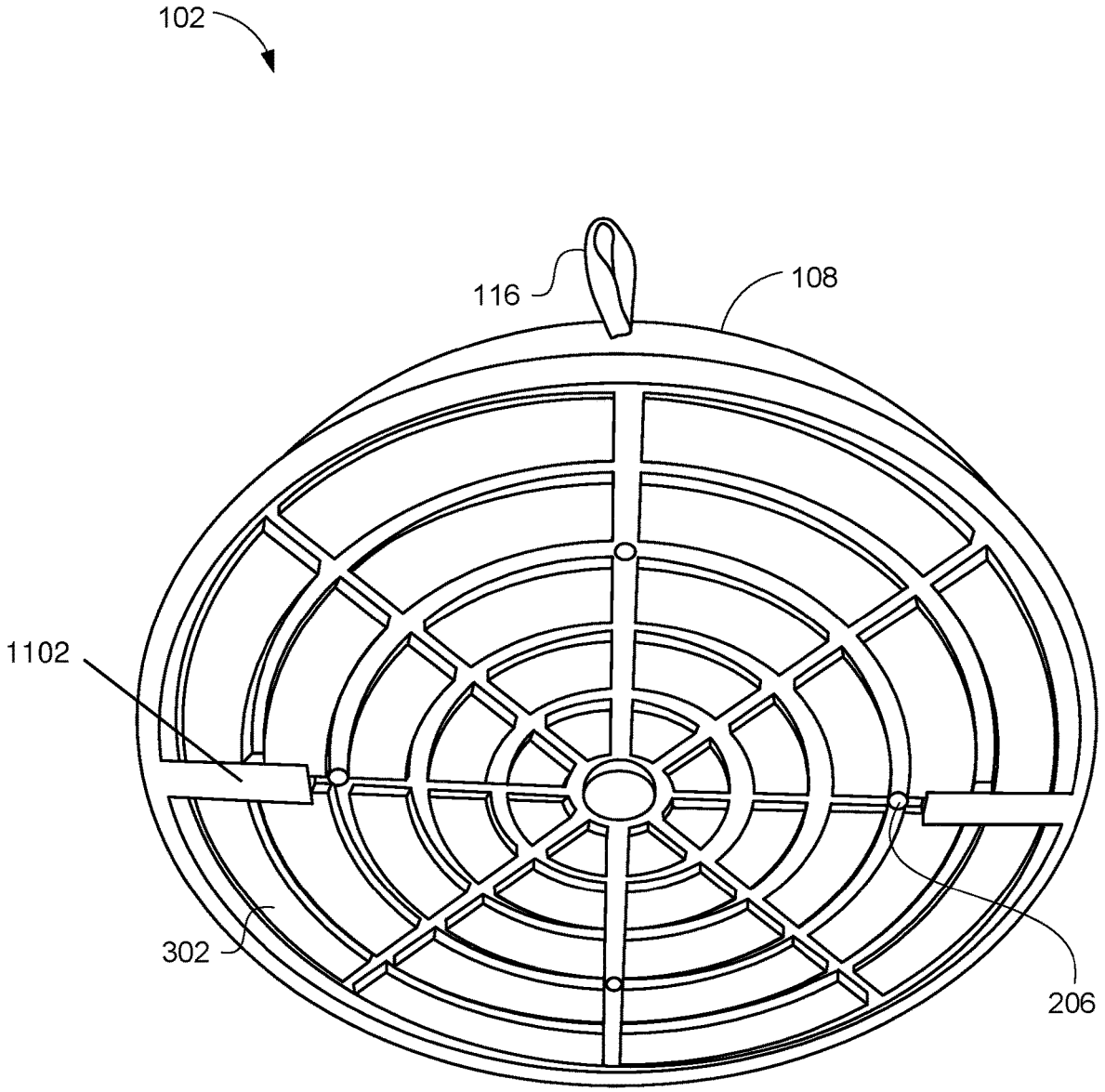
FIG. 3 is a perspective view of one embodiment of a base of a collapsible marker.

FIG. 3 depicts a perspective view of a bottom portion of the base 102. In the illustrated embodiment, the base 102 includes traction features 302. The traction features 302 may be formed in the base 102 or attached to the base 102. In some embodiments, the traction features 302 may be formed on a separate component which is configured to attached to the base 102. In the illustrated embodiment, the traction features 302 are concentric circular portions. In other embodiments, the traction features 302 have other shapes. The traction features 302 may include a surface treatment to improve traction of the traction features 302 relative to the ground or other surfaces.

In the illustrated embodiment, the hardware 206 is visible between the traction features 302. In some embodiments, the hardware 206 may be positioned between or within the traction feature 302. The hardware 206 may include reinforcement such as washers or other structures to improve wear resistance, pull-through strength, tensile strength, accessibility, and the like.

Figure 4:
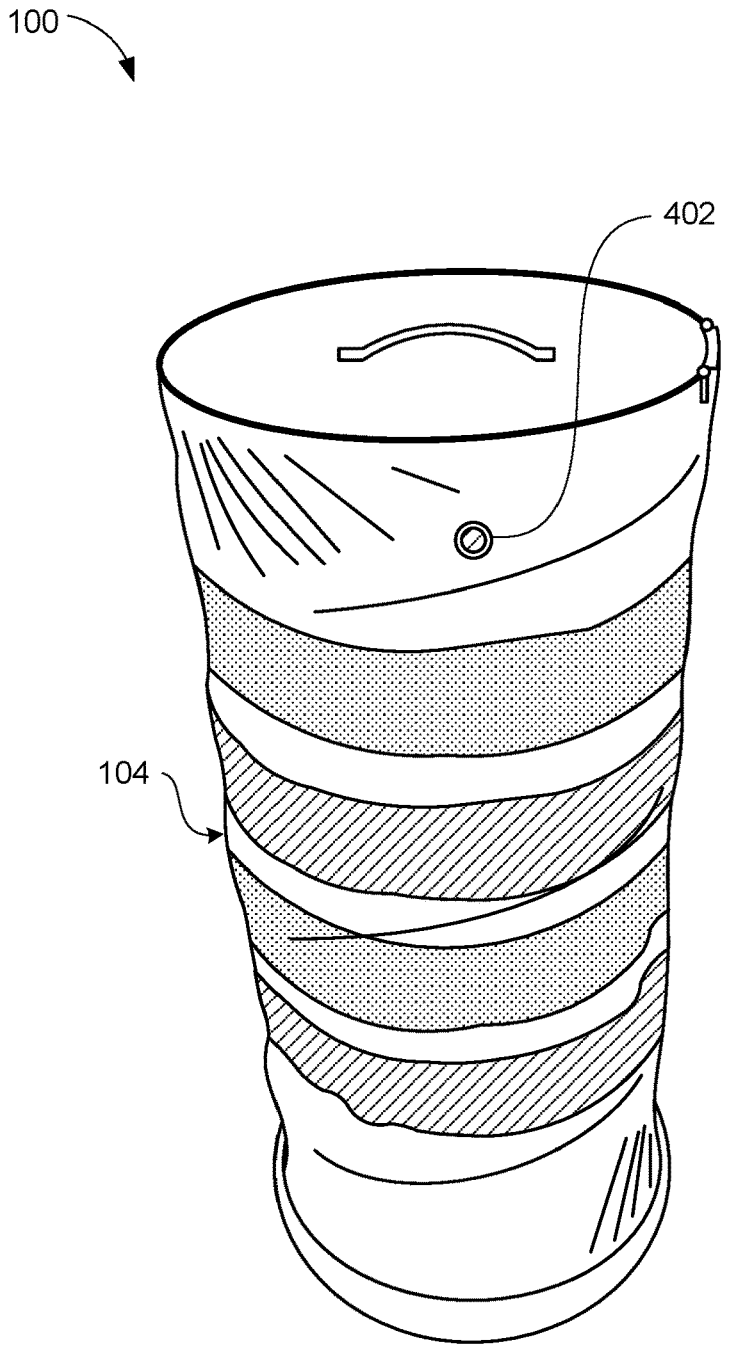
FIG. 4 is a perspective view of another embodiment of a collapsible marker.

FIG. 4 illustrates a perspective view of one embodiment of the marker 100. As shown, a vent 402 is disposed in a side of the body 104 of the marker 100. In this embodiment, the vent 402 is a grommet or through-hole allowing air to pass into and out of the body 104 of the marker 100. In some embodiments, the vent 402 is in a permanently open state. In other embodiments, the vent 402 may be opened and closed. In the illustrated embodiment, a single vent 402 is shown. In other embodiments, multiple vents 402 may be disposed at different locations on the body 104 or other portions or components of the marker 100.

Figure 5:
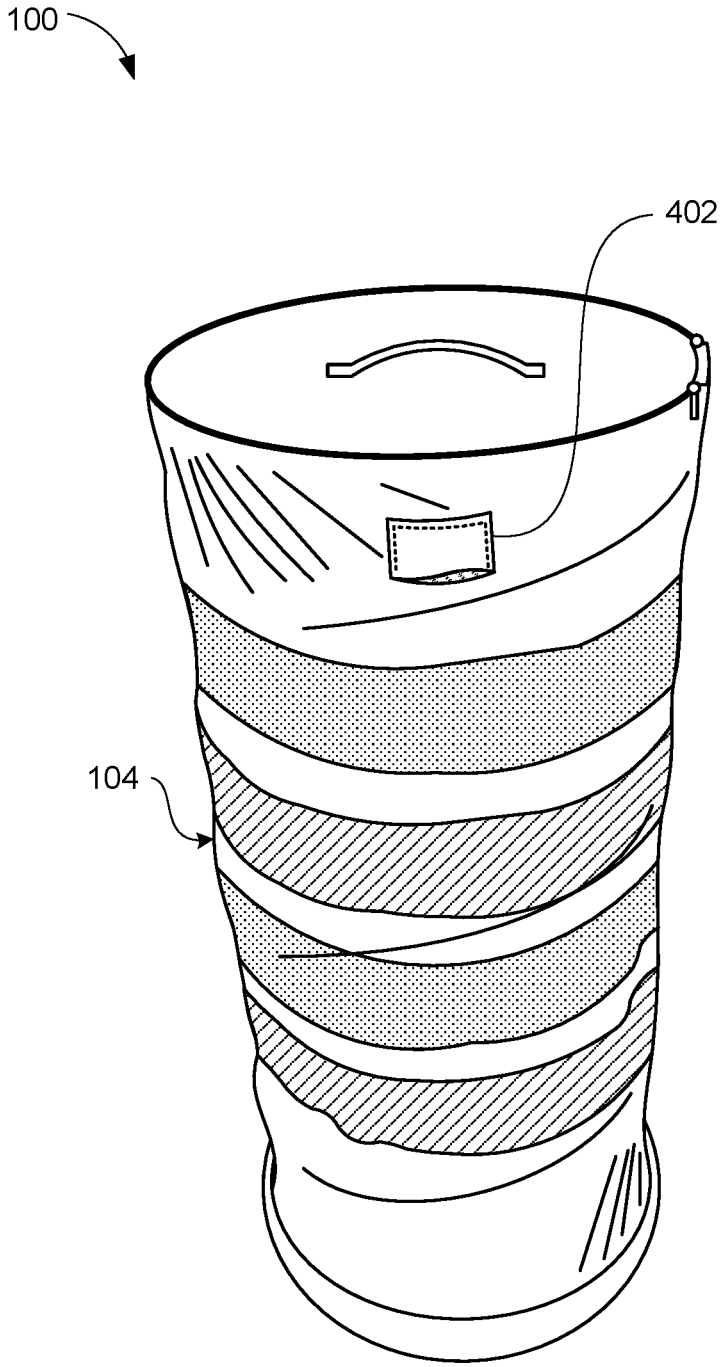
FIG. 5 is a perspective view of another embodiment of a collapsible marker.

FIG. 5 illustrates a perspective view of another embodiment of the marker 100. In the illustrated embodiment, the vent 402 is a flap disposed on the body 104 of the marker 100. The vent 402 may be positioned to resist water and particulate ingress while facilitating the passage of air during collapse and/or expansion of the marker 100. In some embodiments, a mesh or other air-permeable material or structure may be incorporated in to the vent 402 to add strength, tear-resistance, ingress-protection, or the like.

Figure 6:
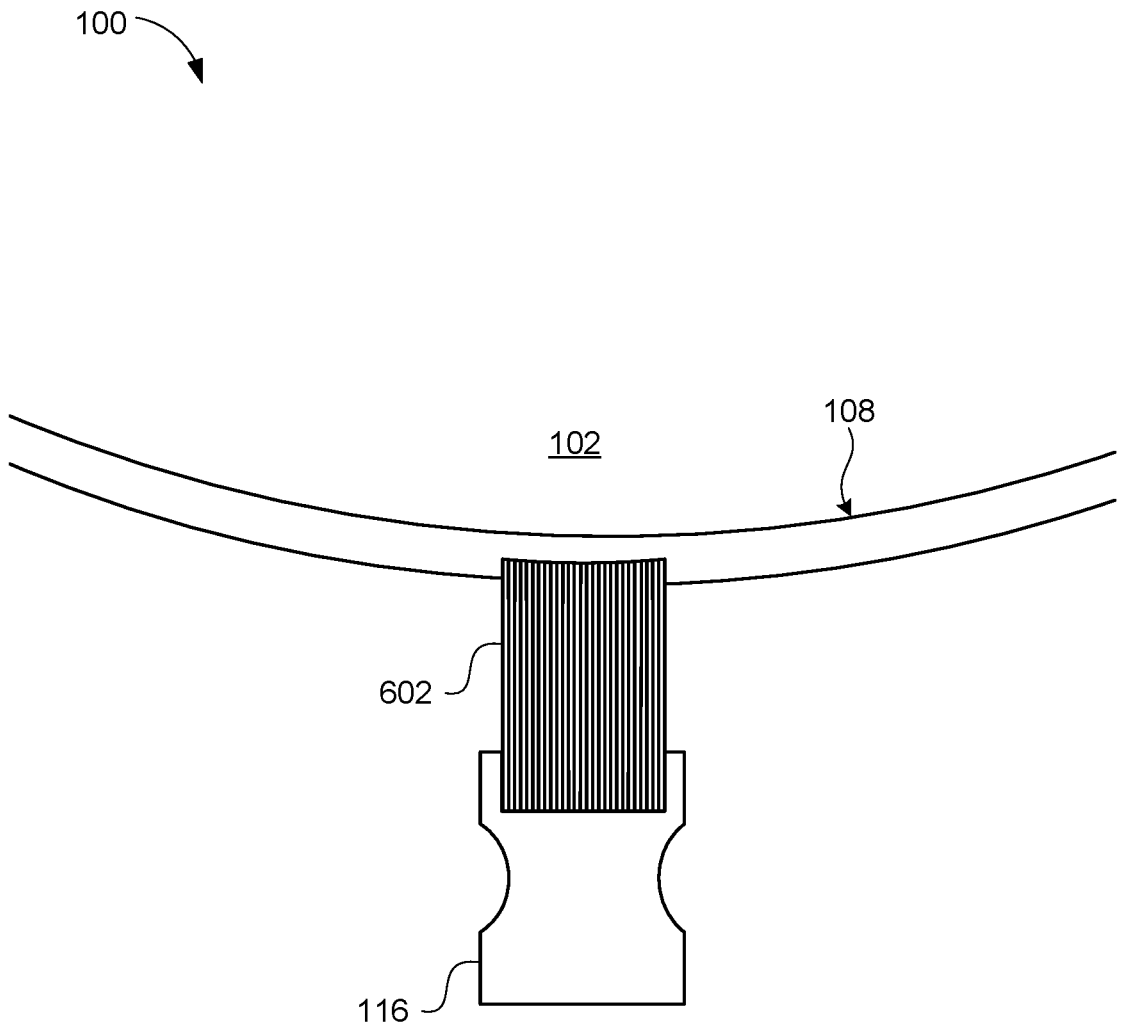
FIG. 6 is a perspective view of one embodiment of a base coupling element of a collapsible marker.

FIG. 6 illustrates a perspective view of one embodiment of a base coupling element 116. In the illustrated embodiment, the base coupling element 116 is a buckle. The buckle may be attached to the lip 108 of the base 102 via a strap 602. The strap 602 may be looped through the buckle or otherwise attached to the base coupling element 116. The strap 602 may be coupled to the base 102 at the lip 108 or another portion of the base 102. The strap 602 may be molded into the base 102. In other embodiments, the strap 602 is adhered, bonded, or mechanically attached via hardware or other structures. In some embodiments, the base coupling element 116 is removable relative to the strap 602 and/or the base 102. In other embodiments, the base coupling element 116 is non-removably attached to the strap 602 and/or the base 102. In some embodiments, the base coupling element 116 is removable to facilitate repair or replacement of the base coupling element 116, the strap 602, and/or the base 102.

In some embodiments, the strap 602 is a woven material such as a nylon, canvas, polyester, or other synthetic or natural materials or composite of materials. The length of the strap 602 may be adjustable or fixed. In some embodiments, the strap 602 extends through a diameter of the base 102 to another base coupling element 116 on an opposite side of the base 102.

Figure 7:
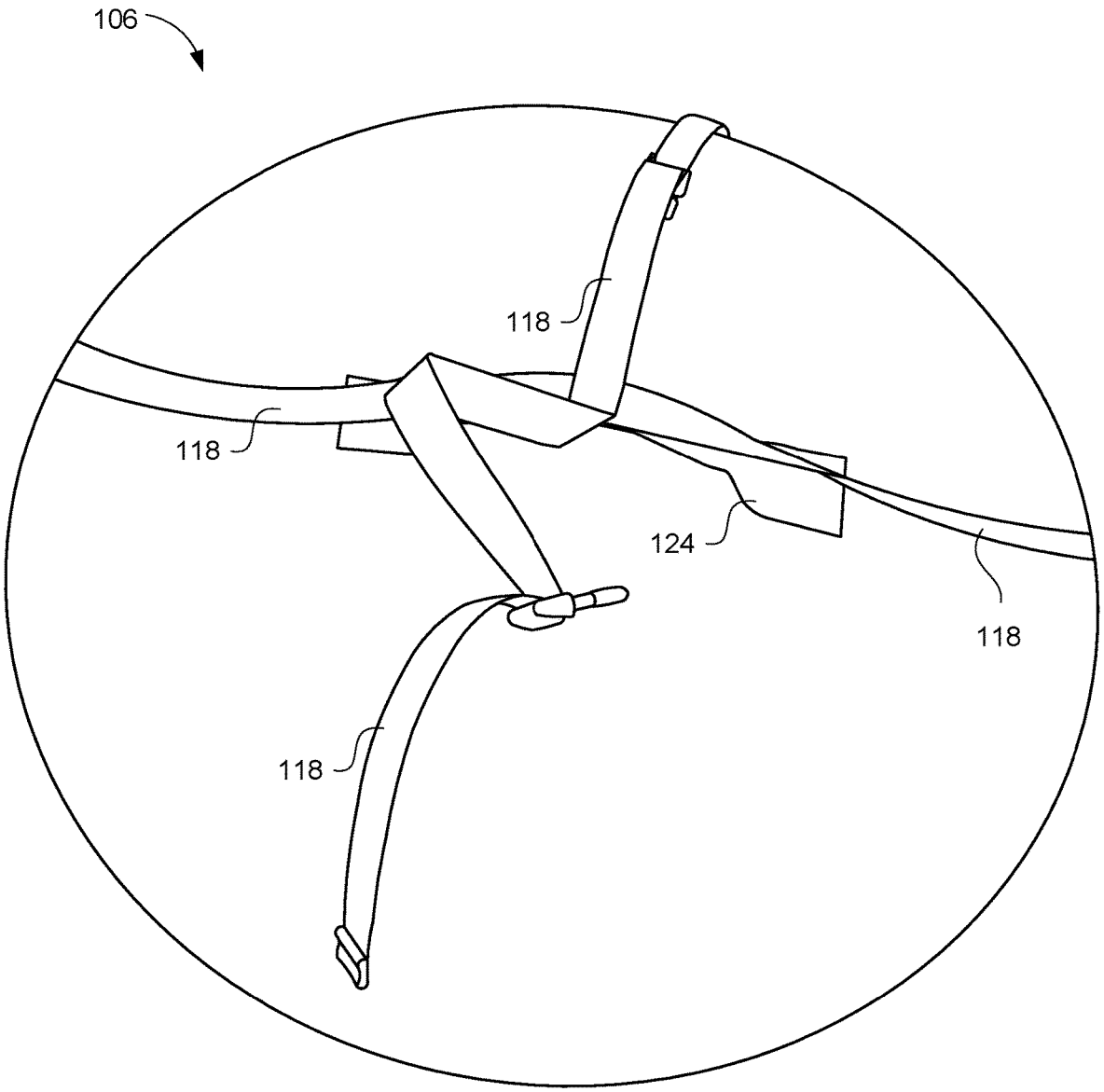
FIG. 7 is a perspective view of one embodiment of a cap of a collapsible marker.

FIG. 7 illustrates another embodiment of the cap 106. In the illustrated embodiment, the cap 106 includes the cap coupling element 118. As shown, the cap coupling element is a strap and buckle arrangement. In the illustrated embodiment, the cap coupling element 118 is attached to a top of the handle 124. In other embodiments, the cap coupling element 118 is disposed on the cap 106 beneath the handle 124. The cap coupling element 118 may be coupled to other portions of the cap 106 or to the body 104. In some embodiments, the cap coupling element 118 and the base coupling element 116 is combined into a single structure. For example, a strap may be coupled to one side of the base 102 and reach to an opposite side of the base 102 over the cap 106 to secure the marker 100 in a collapsed state. Other arrangements and positions of the base coupling element 116 and the cap coupling element 118 are also contemplated.

Figure 8:
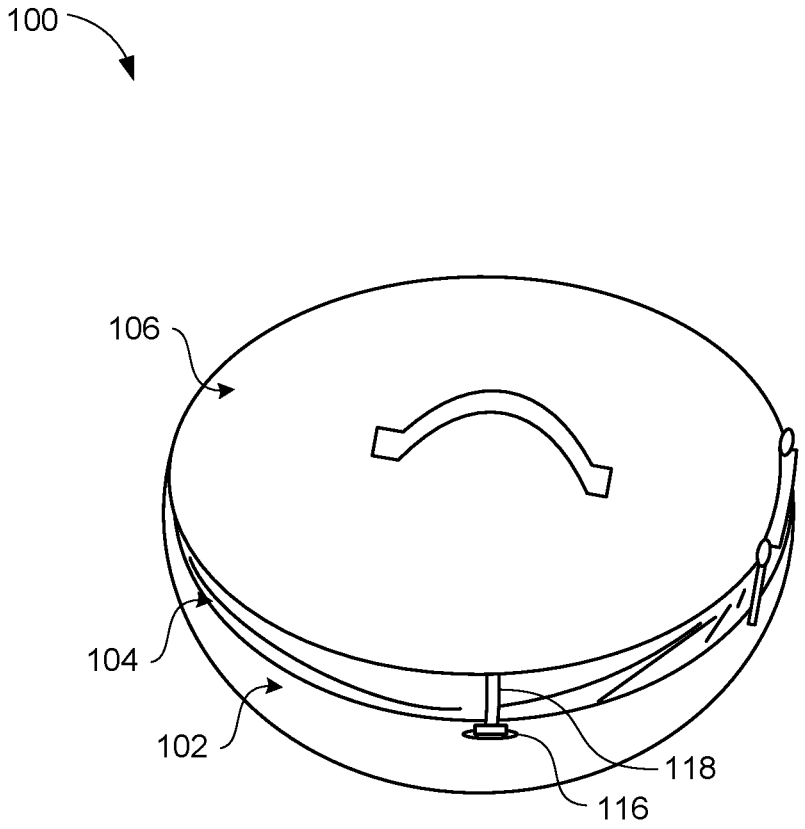
FIG. 8 is a perspective view of another embodiment of a cap of the a collapsible marker.

FIG. 8 illustrates one embodiment of the marker 100 in a collapsed state. In the illustrated embodiment, the marker 100 is secured by collapsing the body 104 into the base 102 and securing the cap 106 to the base 102 with the cap coupling elements 118 engaging the base coupling elements 116. Again, the coupling elements 116 and 118 shown are toggle and loop but may be buckles, hooks, hook-and-loop, buttons, clasps, straps, or the like.

In the collapsed state, the marker 100 benefits from improved portability, reduced storage requirements with reduced size and improved stability with a lower center of gravity, etc. in the illustrated embodiment, the cap 106 is coupled directly to the base 102. In other embodiments, a portion of the body 104 may couple to the base 102 to secure the marker 100 in the collapsed state.

In the illustrated embodiment, the marker 100 is fully collapsed. In some embodiments, the marker 100 may be partially collapsed/extended. A partial collapse/extension may be achieved by positioning the cap coupling element 118 on the body 104 of the marker 100, by one or both of the cap coupling elements 118 and the base coupling elements 116 having a greater length, or by one or both of the cap coupling elements 118 or the base coupling elements 116 being elastic or adjustable in length. Additionally, the height of the body 104 of the marker 100 may be modified with collapsible sections of the body 104. For example, expansion segments may be formed in the body 104 which are secured using zippers, buttons, snaps, clips, hooks, and the like to shorten or lengthen the body 104.

Figure 9:
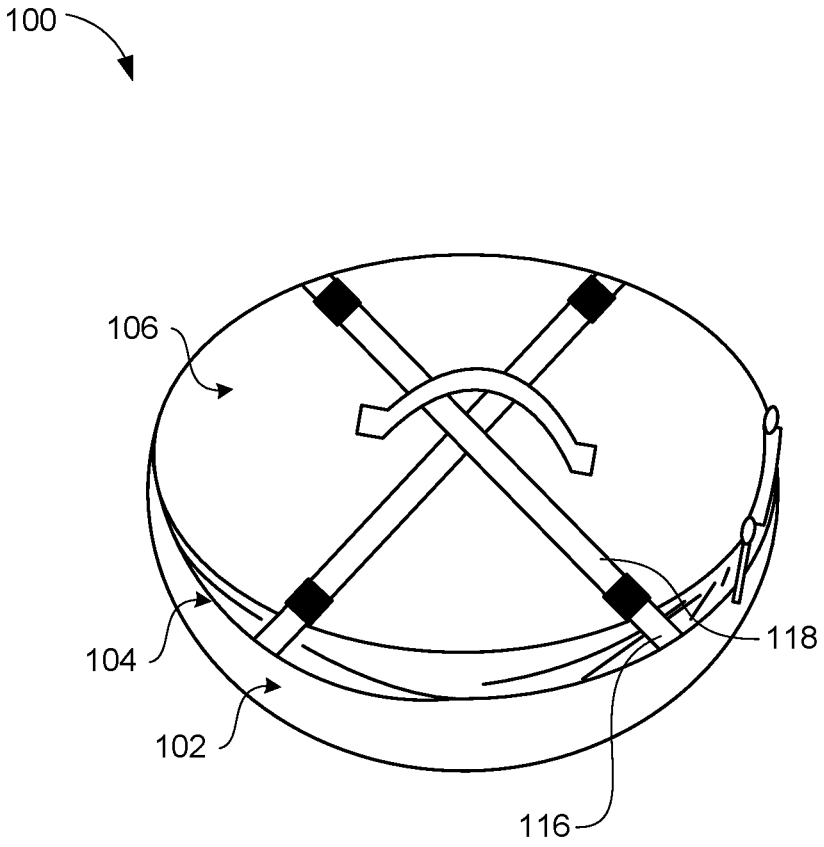
FIG. 9 is a perspective view of another embodiment of a cap of the a collapsible marker.

FIG. 9 illustrates another embodiment of the marker 100 in a collapsed state. In the illustrated embodiment, the base coupling elements 116 and the cap coupling elements 118 are strap and buckle configurations crossing over the cap 106 of the marker 100 to compress the body 104 into the base 102. In the illustrated embodiment, the base coupling elements 116 and the cap coupling elements 118 have four separate points of connection. In other embodiments, the base coupling elements 116 and the cap coupling elements 118 may have fewer or more points of connection.

Figure 10:
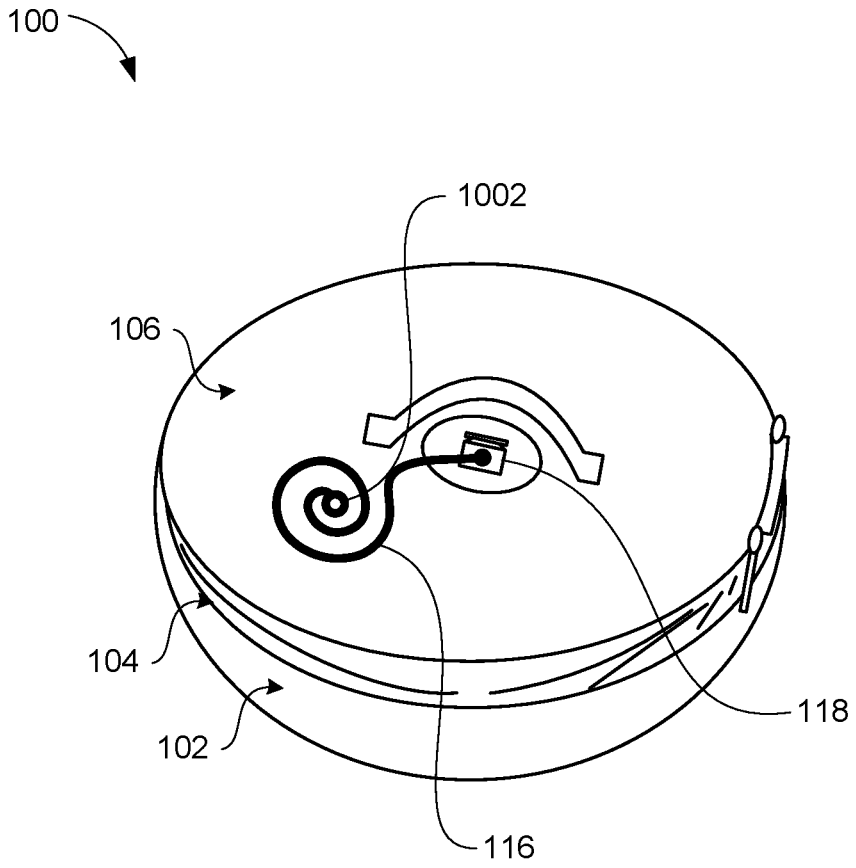
FIG. 10 is a perspective view of another embodiment of a cap of the a collapsible marker.

FIG. 10 illustrates another embodiment of the marker 100 in a collapse state. In the illustrated embodiment, the base coupling element 116 takes the form of a cord, strap, or other elongated member, that is coupled to the base 102 on an interior of the marker 100 and passes through the cap 106 at the cap coupling element 118 which takes the form of a cord lock, clamp, link lock, friction lock, hook, knot, eyelet, or the like. The base coupling element 116 is captured at the cap coupling element 118 to apply tension on the base coupling element 116 and maintain the marker 100 in a collapsed state. In the illustrated embodiment, the base coupling element 116 may also include a stopper 1002 to prevent pull-through of the base coupling element 116 relative to the cap coupling element 118 when the marker 100 is fully erected. In some embodiments, the illustrated arrangement allows for quick deployment and take-down.

Figure 11:
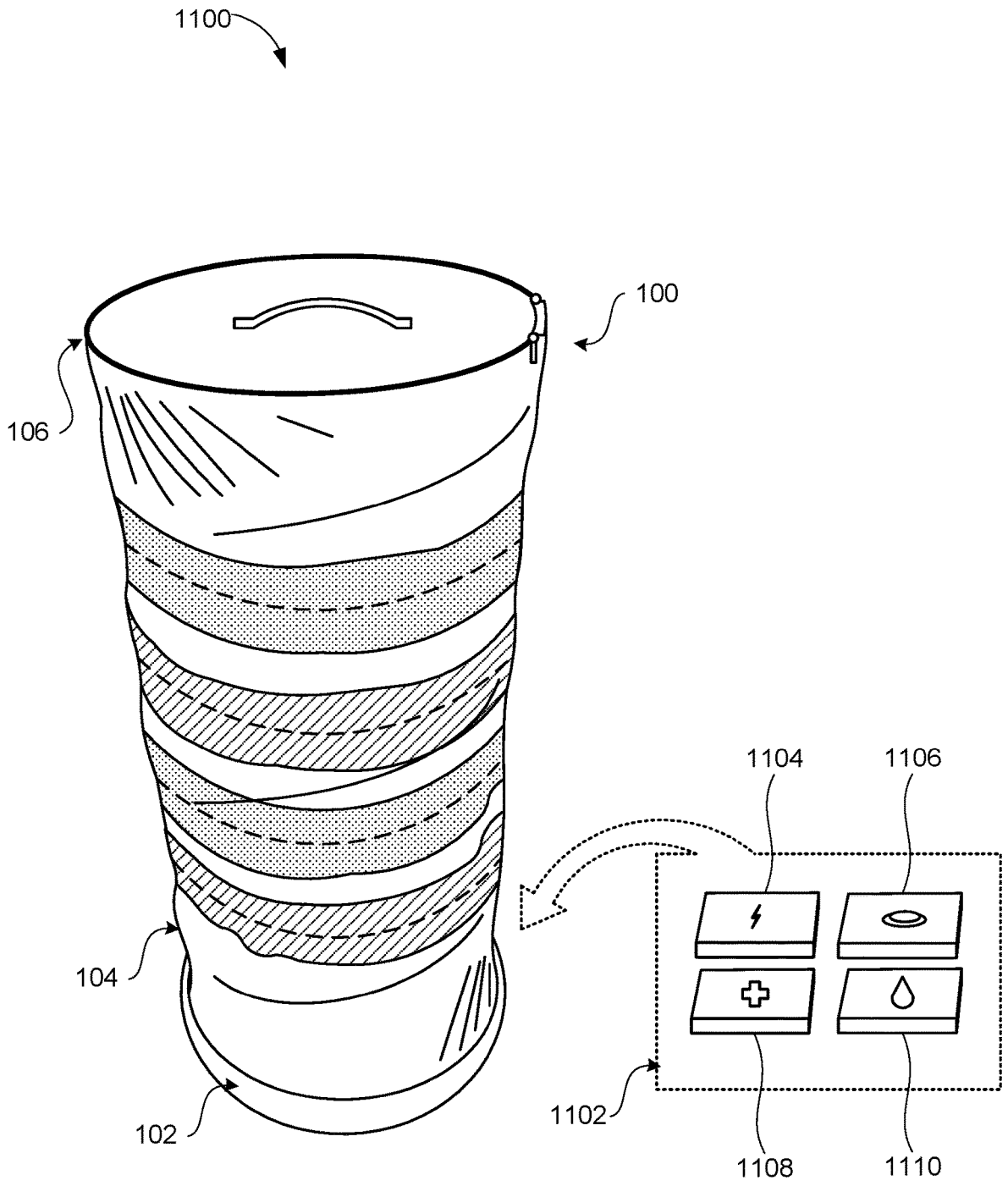
FIG. 11 is a perspective view of one embodiment of a collapsible marker with emergency equipment inside.

FIG. 11 illustrates one embodiment of an emergency kit 1100. In the illustrated embodiment, the marker 100 may be used to store emergency equipment 1102. For example, the emergency equipment 1102 may include a power source 1104 such as a battery, jumper pack, jumper cables, or the like. The emergency equipment 1102 may also include food 1106, first aid 1108, and/or water 1110. Other emergency supplies or items may also be included.

In some embodiments, the emergency equipment 1102 may be stored in the marker 100 in a collapsed state. This facilitates use of the marker 100 as carried in a vehicle to serve as a roadside and emergency resource for occupants of the vehicle. Embodiments of the marker 100 described provide benefits for private owners, law enforcement individuals, commercial entities and drivers, and the like.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

a collapsible body comprising a spring element coupled to the body to apply an extension force, the spring element having a helical geometry and the collapsible body having a high visibility characteristic;

a base coupled to a first end of the body comprising traction features, the base having a shape to secure the body and the spring element relative to the base and to receive the body in a collapsed state, wherein the base comprises a base coupling element to secure the body in the collapsed state and the base coupling element is removable relative to the apparatus;

a cap coupled to a second end of the body opposite the first end, the cap to, at least partially, close the second end of the body;

hardware positioned within or between the traction features of the base when the collapsible body is in a collapsed state;

a plate configured to fit within the base, wherein the hardware is removably attached to the plate;

a power source formed within the plate; and a lighting element connected to the power supply and facing an interior of the body.

2. The apparatus of claim 1, wherein the body comprises a flexible outer material that at least partially encloses the spring element.

3. The apparatus of claim 1, wherein the body comprises a vent to allow at least air to pass through the body.

4. The apparatus of claim 1, wherein the spring element is a continuous element extending along a full length of the collapsible body.

5. The apparatus of claim 1, wherein the spring element comprises multiple segments.

6. The apparatus of claim 1, wherein the spring element is coupled to the body with one or more retaining sleeves.

7. The apparatus of claim 1, wherein the spring element applies an outward force on the body to maintain a shape of the body.

8. The apparatus of claim 1, wherein the body is secured relative to the base by the spring element.

9. The apparatus of claim 1, wherein the base includes at least one component molded into the base.

10. The apparatus of claim 1, wherein the cap is at least partially removably coupled to the base.

11. The apparatus of claim 1, the power source comprising at least one of: a battery, a generator, or a vehicle connection.

12. The apparatus of claim 1, wherein the traction features are curved.

* * * * *